United States Patent [19]

Honda et al.

[11] 4,086,189

[45] Apr. 25, 1978

[54] RESISTIVE ELEMENT HAVING VOLTAGE NON-LINEARITY AND METHOD OF MAKING SAME

[75] Inventors: Tetsuya Honda, Amagasaki; Kiyoshi Yagi, Takatsuki; Seiji Shibata, Kobe; Kazuo Yamaguchi, Osaka, all of Japan

[73] Assignee: Otowa Electric Company, Ltd., Japan

[21] Appl. No.: 722,006

[22] Filed: Sep. 10, 1976

[30] Foreign Application Priority Data

Nov. 14, 1975 Japan ..... 50-137520

[51] Int. Cl.[2] ..... H01B 1/08

[52] U.S. Cl. ..... 252/519; 252/518; 252/521

[58] Field of Search ..... 252/519, 518, 521

[56] References Cited

U.S. PATENT DOCUMENTS

| | | | |
|---|---|---|---|
| 3,670,216 | 6/1972 | Masuyama et al. | 357/10 X |
| 3,836,483 | 9/1974 | Ichinose et al. | 252/521 X |
| 3,925,261 | 12/1975 | Lauterbach-Dammler | 252/519 |

*Primary Examiner*—Benjamin R. Padgett
*Assistant Examiner*—E. Suzanne Parr
*Attorney, Agent, or Firm*—Eugene E. Geoffrey, Jr.

[57] ABSTRACT

A non-linear resistive element which is formed by sintering a body of zinc oxide which includes cobalt, strontium, barium, yttrium and magnesium.

3 Claims, No Drawings

RESISTIVE ELEMENT HAVING VOLTAGE NON-LINEARITY AND METHOD OF MAKING SAME

This invention relates to an improved resistive element including zinc oxide as a host material and having non-linear voltage-current characteristic.

Resistive elements having voltage non-linearity, which have been put in practical use, so-called "varisters", are classified into silicon carbide group, silicon group, selenium group, cuprous oxide group, sintered zinc oxide group and the like. Of these groups, varisters of the sintered zinc oxide group have many advantages in that they can withstand surges, have superior non-linear voltage-current characteristics, are easily manufactured by conventional techniques of the ceramic industry, and can be easily miniaturized and readily accommodated to various voltages by changing the size of sintered body.

In the varisters of sintered zinc oxide group, those containing various additives, such as cobalt, strontium and barium, have been well known. Generally speaking, however, they are insufficient in the voltage non-linear characteristic and are easily deteriorated by application of impulse currents and exhibit a large leakage current and short lifetime when put into such severe use as a lightning arrester.

Therefore, an object of this invention is to provide an improved resistive element having a superior voltage-non-linearity and exhibiting less deterioration caused by impulse currents.

When a voltage V is applied to a resistive element having voltage non-linearity, current flowing therethrough is given by an equation, as follows:

$$I = \left(\frac{V}{C}\right)^{\alpha}$$

where C is the voltage per 1 mm thickness of the element when the current density is 1 mA/cm$^2$ and $\alpha$ is a non-linearity index. The more the value of $\alpha$ approaches a unity, the more the relation of the above equation approaches Ohm's law, and the greater it becomes, the better the voltage non-linearity. For convenience, the voltage V is measured at both 1 mA and 10mA of current I. These values are applied to the above equation to calculate the value of $\alpha$ and this value is indicated by $\alpha_1$. Then, the object of this invention is firstly to make this value $\alpha_1$ as large as possible.

On the other hand, a voltage $V_1$ which is to be applied across one millimeter thickness of the element for making one milliampere current flow therethrough is measured and this voltage is referred hereinunder as the "varister voltage". The varister voltage $V_1$ is reduced by application of an impulse across the element and its percent reduction $\Delta V_1$ is a representation of durability of the element. Accordingly, the object of this invention is secondly to make this value $\Delta V_1$ measured under the same conditions as small as possible.

The improved resistive element according to this invention comprises a sintered body of zinc oxide containing 0.2 to 5 molar percent of cobalt, 0.2 to 2 molar percent of strontium, 0.05 to 3 molar percent of barium, 0.05 to 10 molar percent of yttrium and 0.05 to 12 molar percent of magnesium calculated in the forms of CoO, SrO, BaO, $Y_2O_3$ and MgO, respectively.

The features of this invention will be clarified further by the following description made in conjunction with a number of examples.

The varister specimens used for the following examples were made as follows. Zinc oxide powder as the host material was intermixed with powdered oxide additives by molar percents as shown in Table 1 and fired in air at 800° C. The fired mixture was pulverized, a small amount of polyvinyl alcohol was added as a binder and then formed into a circular disc of 30 millimeter in diameter and 3 millimeters in thickness by a conventional dry forming technique. The disc was fired in air at 1200° to 1350° C to be sintered and, after confirming the absence of water absorbing properties in the sintered product, silver electrodes were formed on the both surfaces thereof with silver frit No. 7095 manufactured by Du Pont Chemical Co.

TABLE i(a)

| Ex. | CoO(mol %) | BaO(mol %) | $Y_2O_3$(mol %) | MgO(mol %) |
|---|---|---|---|---|
| A1.1 | 0.00 | 0.5 | 0.5 | 0.5 |
| .2 | 0.05 | " | " | " |
| .3 | 0.1 | " | " | " |
| .4 | 0.5 | " | " | " |
| .5 | 1.0 | " | " | " |
| .6 | 3.0 | " | " | " |
| .7 | 5.0 | " | " | " |
| A2.1 | 0.5 | 0.00 | " | " |
| .2 | " | 0.05 | " | " |
| .3 | " | 0.1 | " | " |
| .4 | " | 0.5 | " | " |
| .5 | " | 1.0 | " | " |
| .6 | " | 3.0 | " | " |
| .7 | " | 5.0 | " | " |
| A3.1 | " | 0.5 | 0.00 | " |
| .2 | " | " | 0.05 | " |
| .3 | " | " | 0.1 | " |
| .4 | " | " | 0.5 | " |
| .5 | " | " | 1.0 | " |
| .6 | " | " | 3.0 | " |
| .7 | " | " | 5.0 | " |
| A4.1 | " | " | 0.5 | 0.00 |
| .2 | " | " | " | 0.05 |
| .3 | " | " | " | 0.1 |
| .4 | " | " | " | 0.5 |
| .5 | " | " | " | 1.0 |
| .6 | " | " | " | 3.0 |
| .7 | " | " | " | 5.0 |

TABLE 1(b)

| Ex. | CoO(mol %) | SrO(mol %) | $Y_2O_3$(mol %) | MgO(mol %) |
|---|---|---|---|---|
| B1.1 | 0.00 | 0.5 | 0.5 | 0.5 |
| .2 | 0.05 | " | " | " |
| .3 | 0.1 | " | " | " |
| .4 | 0.5 | " | " | " |
| .5 | 1.0 | " | " | " |
| .6 | 3.0 | " | " | " |
| .7 | 5.0 | " | " | " |
| .8 | 10.0 | " | " | " |
| B2.1 | 0.5 | 0.00 | " | " |
| .2 | " | 0.05 | " | " |
| .3 | " | 0.1 | " | " |
| .4 | " | 0.5 | " | " |
| .5 | " | 1.0 | " | " |
| .6 | " | 3.0 | " | " |
| .7 | " | 5.0 | " | " |
| B3.1 | " | 0.5 | 0.00 | " |
| .2 | " | " | 0.05 | " |
| .3 | " | " | 0.1 | " |
| .4 | " | " | 0.5 | " |
| .5 | " | " | 1.0 | " |
| .6 | " | " | 3.0 | " |
| .7 | " | " | 5.0 | " |
| .8 | " | " | 10.0 | " |
| .9 | " | " | 15.0 | " |
| B4.1 | " | " | 0.5 | 0.00 |
| .2 | " | " | " | 0.05 |
| .3 | " | " | " | 0.1 |
| .4 | " | " | " | 0.5 |
| .5 | " | " | " | 1.0 |
| .6 | " | " | " | 3.0 |
| .7 | " | " | " | 5.0 |

TABLE 1(b)-continued

| Ex. | CoO(mol %) | SrO(mol %) | $Y_2O_3$(mol %) | MgO(mol %) |
|---|---|---|---|---|
| .8 | " | " | " | 10.0 |
| .9 | " | " | " | 15.0 |

TABLE 1(c)

| Example | CoO(mol %) | SrO(mol %) | BaO(mol %) | $Y_2O_3$(mol %) | MgO(mol %) |
|---|---|---|---|---|---|
| C1.1 | 0.00 | 0.5 | 0.5 | 0.5 | 0.5 |
| .2 | 0.05 | " | " | " | " |
| .3 | 0.1 | " | " | " | " |
| .4 | 0.2 | " | " | " | " |
| .5 | 0.5 | " | " | " | " |
| .6 | 1.0 | " | " | " | " |
| .7 | 3.0 | " | " | " | " |
| .8 | 5.0 | " | " | " | " |
| .9 | 10.0 | " | " | " | " |
| C2.1 | 0.5 | 0.00 | " | " | " |
| .2 | " | 0.05 | " | " | " |
| .3 | " | 0.1 | " | " | " |
| .4 | " | 0.2 | " | " | " |
| .5 | " | 0.5 | " | " | " |
| .6 | " | 1.0 | " | " | " |
| .7 | " | 2.0 | " | " | " |
| .8 | " | 3.0 | " | " | " |
| .9 | " | 5.0 | " | " | " |
| .10 | " | 10.0 | " | " | " |
| C3.1 | " | 0.5 | 0.00 | " | " |
| .2 | " | " | 0.05 | " | " |
| .3 | " | " | 0.1 | " | " |
| .4 | " | " | 0.5 | " | " |
| .5 | " | " | 1.0 | " | " |
| .6 | " | " | 3.0 | " | " |
| .7 | " | " | 5.0 | " | " |
| .8 | " | " | 10.0 | " | " |
| C4.1 | " | " | 0.5 | 0.00 | " |
| .2 | " | " | " | 0.05 | " |
| .3 | " | " | " | 0.1 | " |
| .4 | " | " | " | 0.5 | " |
| .5 | " | " | " | 1.0 | " |
| .6 | " | " | " | 3.0 | " |
| .7 | " | " | " | 5.0 | " |
| .8 | " | " | " | 10.0 | " |
| .9 | " | " | " | 12.0 | " |
| .10 | " | " | " | 15.0 | " |
| C5.1 | " | " | " | 0.5 | 0.00 |
| .2 | " | " | " | " | 0.05 |
| .3 | " | " | " | " | 0.1 |
| .4 | " | " | " | " | 0.5 |
| .5 | " | " | " | " | 1.0 |
| .6 | " | " | " | " | 3.0 |
| .7 | " | " | " | " | 5.0 |
| .8 | " | " | " | " | 10.0 |
| .9 | " | " | " | " | 12.0 |
| .10 | " | " | " | " | 15.0 |

As shown in Table 1, Examples A do not contain SrO and Examples B do not contain BaO, while Examples C contain all of five kinds of additive oxide, CoO, SrO, BaO, $Y_2O_3$ and MgO.

The varister voltage $V_1$ and non-linearity indexes $\alpha_1$ of all examples were measured and calculated as above-mentioned and the percent variations $\Delta V_1$ were measured by an impulse current test in which a standard impulse current form having a virtual duration of wave-front of 8 microsends, a virtual duration of wave-tail of 20 microseconds and a peak value of 5000 amperes. This impulse current, used for lightning arrester test, was applied between the both electrodes of the element. The measured values are given in Table 2.

TABLE 2(a)

| Example | $V_1$ (volt) | $\alpha_1$ | $\Delta V_1$ (%) |
|---|---|---|---|
| A1.1 | 6.7 | 2.4 | −25.7 |
| .2 | 32.8 | 4.2 | −18.8 |
| .3 | 75 | 10.1 | −12.9 |
| .4 | 90 | 13.5 | −6.6 |
| .5 | 170 | 20.0 | −7.0 |
| .6 | 244 | 33.2 | −20.0 |
| .7 | 350 | 37.7 | −30.0 |
| A2.1 | 200 | 5.8 | −25.0 |
| .2 | 150 | 7.1 | −18.6 |
| .3 | 120 | 11.0 | −7.8 |
| .4 | 90 | 13.5 | −6.6 |

TABLE 2(a)-continued

| Example | $V_1$ (volt) | $\alpha_1$ | $\Delta V_1$ (%) |
|---|---|---|---|
| .5 | 68 | 14.0 | −7.0 |
| .6 | 58 | 22.0 | −11.4 |
| .7 | 45 | 16.0 | −19.4 |
| A3.1 | 40 | 4.4 | −7.6 |
| .2 | 30 | 7.3 | −7.0 |
| .3 | 25 | 9.0 | −6.8 |
| .4 | 90 | 13.5 | −6.6 |
| .5 | 110 | 14.0 | −7.7 |
| .6 | 170 | 22.0 | −8.9 |
| .7 | 230 | 30.0 | −15.0 |
| A4.1 | 130 | 8.3 | −7.8 |
| .2 | 110 | 10.0 | −7.4 |
| .3 | 100 | 11.0 | −7.3 |
| .4 | 90 | 13.5 | −6.6 |
| .5 | 97 | 16.0 | −8.4 |
| .6 | 134 | 18.0 | −9.0 |
| .7 | 192 | 20.0 | −14.1 |

TABLE 2(a)

| Example | $V_1$ (volt) | $\alpha_1$ | $\Delta V_1$ (%) |
|---|---|---|---|
| B1.1 | 25 | 2.5 | −40 |
| .2 | 50 | 7.7 | −25 |
| .3 | 80 | 14.2 | −20 |
| .4 | 155 | 41.8 | −16 |
| .5 | 165 | 49.1 | −8.4 |
| .6 | 179 | 60.0 | −5.6 |
| .7 | 187 | 53.5 | −6.7 |
| .8 | 195 | 35.0 | −20 |
| B2.1 | 200 | 5.8 | −25 |
| .2 | 168 | 12.6 | −23 |
| .3 | 160 | 23.5 | −20 |
| .4 | 155 | 41.8 | −16 |
| .5 | 151 | 43.1 | −13.8 |
| .6 | 173 | 44.8 | −10.9 |
| .7 | 217 | 22.0 | −23 |
| B3.1 | 194 | 35.0 | −16.3 |

TABLE 2(a)-continued

| Example | $V_1$ (volt) | $\alpha_1$ | $\Delta V_1$ (%) |
|---|---|---|---|
| .2 | 106 | 40.0 | −15.2 |
| .3 | 85 | 41.0 | −10.1 |
| .4 | 155 | 41.8 | −16.0 |
| .5 | 175 | 48.0 | −11.3 |
| .6 | 191 | 58.8 | −10.3 |
| .7 | 221 | 60.0 | −15.2 |
| .8 | 278 | 44.5 | −20 |
| .9 | 335 | 30.0 | −27 |
| B4.1 | 83 | 40.6 | −15.8 |
| .2 | 114 | 41.0 | −13.2 |
| .3 | 128 | 41.3 | −11.3 |
| .4 | 155 | 41.8 | −16.0 |
| .5 | 172 | 49.6 | −8.9 |
| .6 | 197 | 60.3 | −5.7 |
| .7 | 230 | 54.7 | −10 |
| .8 | 332 | 44.5 | −20 |
| .9 | 429 | 32.8 | −30 |

TABLE 2(c)

| Example | $V_1$ (volt) | $\alpha_1$ | $\Delta V_1$ (%) |
|---|---|---|---|
| C1.1 | 15 | 4.5 | −9.8 |
| .2 | 20 | 4.9 | −8.7 |
| .3 | 52 | 18.1 | −4.8 |
| .4 | 89 | 40.1 | −4.0 |
| .5 | 124 | 58.5 | −3.0 |
| .6 | 133 | 62.5 | −2.5 |
| .7 | 187 | 56.4 | −3.5 |
| .8 | 227 | 47.8 | −4.0 |
| .9 | 350 | 24.4 | −13.0 |
| C2.1 | 90 | 13.5 | −6.6 |
| .2 | 116 | 13.9 | −5.3 |
| .3 | 127 | 21.8 | −3.7 |
| .4 | 125 | 41.1 | −3.5 |
| .5 | 124 | 58.5 | −3.0 |
| .6 | 150 | 53.3 | −1.3 |
| .7 | 73 | 40.3 | −3.7 |
| .8 | 80 | 26.6 | −10 |
| .9 | 54 | 17.2 | −30 |
| .10 | 44 | 10.3 | −40 |
| C3.1 | 155 | 41.8 | −16.0 |
| .2 | 147 | 55.0 | −2.6 |
| .3 | 141 | 56.3 | −3.0 |
| .4 | 124 | 58.5 | −3.0 |
| .5 | 110 | 55.5 | −1.0 |
| .6 | 80 | 40.0 | −4.0 |
| .7 | 53 | 28.0 | −9.3 |
| .8 | 20 | 8.3 | −30 |
| C4.1 | 168 | 47.4 | −15.0 |
| .2 | 98 | 55.0 | −3.4 |
| .3 | 95 | 56.3 | −3.5 |
| .4 | 124 | 58.5 | −3.0 |
| .5 | 120 | 59.3 | −3.7 |
| .6 | 170 | 73.6 | −1.5 |
| .7 | 185 | 82.0 | −0.4 |
| .8 | 213 | 65.0 | −2.6 |
| .9 | 221 | 50.3 | −5.3 |
| .10 | 261 | 30.2 | −10 |
| C5.1 | 90 | 41.0 | −9.5 |
| .2 | 108 | 54.5 | −4.1 |
| .3 | 114 | 56.0 | −3.5 |
| .4 | 124 | 58.5 | −3.0 |
| .5 | 134 | 62.0 | −3.0 |
| .6 | 178 | 75.0 | −3.5 |
| .7 | 220 | 83.0 | −3.7 |
| .8 | 260 | 60.0 | −4.0 |
| .9 | 288 | 49.8 | −4.8 |
| .10 | 329 | 31.0 | −11.2 |

For the purpose of comparison, some varister elements consisting of prior art compositions as shown in Table 3 were made and tested under the same conditions as the above. The results of this measurement are also given in the same table.

TABLE 3

| Example | CoO (mol %) | SrO (mol %) | $Y_2O_3$ (mol %) | MgO (mol %) | $V_1$ (volt) | $\alpha_1$ | $\Delta V_1$ (%) |
|---|---|---|---|---|---|---|---|
| D | 0.5 | 0.5 | — | — | 156 | 30 | −17.0 |
| E | 0.5 | 0.5 | 0.5 | — | 83.3 | 40.6 | −15.8 |
| F | 0.5 | 0.5 | — | 0.5 | 194 | 35.0 | −16.3 |

From a comparison of Table 2(a) with Table 3, it is observed that the addition of four components, Co, Ba, Y and Mg (excepting Sr), improved $\Delta V_1$ to a certain extent but did not improve $\alpha_1$ at all. On the other hand, from a comparison of Table 2(b) with Table 3, it is observed that the addition of four separate components, Co, Sr, Y and Mg (excepting Ba), improved $\alpha_1$ to some extent but the improvement in $\Delta V_1$ was not so significant. Accordingly, the object of this invention could not be attained enough by addition of four components though a certain improvement was observed as compared with the prior two or three component addition.

However, by comparing Table 2(c) with Table 3, as well as Tables 2(a) and 2(b), it can be observed clearly that a remarkable improvement was obtained in both $\alpha_1$ and $\Delta V_1$ by addition of five components, Co, Sr, Ba, Y and Mg. From a detailed observation of Table 2(c) with reference to Table 1(c), it can be concluded that $\alpha_1$ can be raised above 40 and $\Delta V_1$ can be limited within 5 percent, thereby improving epochmakingly both voltage non-linearity and impulse durability of varisters, by limiting the amount of additives as follows:

CoO — 0.2 to 5.0 mol%
SrO — 0.2 to 2.0 mol%
BaO — 0.05 to 3.0 mol%
$Y_2O_3$ — 0.05 to 10.0 mol%
MgO — 0.05 to 12.0 mol%

Furthermore, the value of $\alpha_1$ can be raised above 50 by limiting the amount of additives as follows:

CoO — 0.5 to 3.0 mol%
SrO — 0.5 to 1.0 mol%
BaO — 0.05 to 1.0 mol%
$Y_2O_3$ — 0.05 to 10.0 mol%
MgO — 0.05 to 10.0 mol%

As observed in Table 2(c), especially Examples C4 and C5, the value can be raised above 80 and the absolute value of $\Delta V_1$ can be reduced below one percent by selecting adequately the amounts of addition of $Y_2O_3$ and MgO. Examples C3 teach that reduction of varister voltage $V_1$ can be obtained by increasing the amount of BaO.

Although, in the above examples, the additives were intermixed in zinc oxide in the form of oxides, that is, CoO, SrO, BaO, $Y_2O_3$ and MgO, and the molar percentages in Table 1 are those of these oxides, it has been confirmed that these molar percentages of the additives did not change throughout the process including the sintering step. Therefore, the additive metals do not always need to be oxides but can take forms other than oxides, such as simple substances as hydroxides, carbonates and like compounds, provided that they can be transformed by the firing or sintering treatment into oxides which have the above-stated molar percentages, respectively. Accordingly, it should be noted that all sintered varister elements containing Co, Sr, Ba, Y and Mg at the above-specified molar percentages calculated in the form of oxides are within the scope of this invention regardless of the molar composition when intermixed.

It should also be noted that the above examples were given only as an aid in explanation of this invention and various modifications and changes can be made without departing from the scope of this invention. For example, the shape and size of the element may be freely selected in accordance with the use of the element, and the binder material and firing condition may be adequately selected.

What is claimed is:

1. A resistive element having a high non-linearity and a low $\Delta V$ consisting essentially of a sintered body of zinc oxide and cobalt, strontium, barium, yttrium and magnesium in the proportions of 0.2 to 5.0 mol%, 0.2 to 2.0 mol%, 0.05 to 3.0 mol%, 0.05 to 10.0 mol% and 0.05 to 12.0 mol%, respectively, when calculated in the form of oxides, CoO, SrO, BaO, $Y_2O_3$ and MgO, respectively.

2. A resistive element having a high non-linearity and a low $\Delta V$ consisting essentially of a sintered body of zinc oxide and compounds of cobalt, strontium, barium, yttrium and magnesium which are contained as CoO at 0.2 to 5.0 mol%, SrO at 0.2 to 2.0 mol%, BaO at 0.05 to 3.0 mol%, $Y_2O_3$ at 0.05 to 10.0 mol% and MgO at 0.05 to 12.0 mol%, respectively.

3. A method of manufacturing the resistive element of claim 2, comprising the steps of intermixing cobalt, strontium, barium, yttrium and magnesium in zinc oxide powder in the form of simple substances or compounds, and shaping and sintering this mixture.

* * * * *